United States Patent [19]

Cumming et al.

[11] Patent Number: 4,805,068

[45] Date of Patent: Feb. 14, 1989

[54] FILM CLEANER METHOD AND APPARATUS

[75] Inventors: Newell E. Cumming; James E. Sidell, both of Encino, Calif.

[73] Assignee: Cumming Corporation, Chatsworth, Calif.

[21] Appl. No.: 173,890

[22] Filed: Mar. 28, 1988

Related U.S. Application Data

[63] Continuation-in-part of Ser. No. 14,729, Feb. 13, 1987, Pat. No. 4,750,080.

[51] Int. Cl.[4] ..... H05F 3/06
[52] U.S. Cl. ..... 361/213
[58] Field of Search ..... 361/213, 229, 221, 230, 361/231, 235

[56] References Cited

U.S. PATENT DOCUMENTS

| | | | |
|---|---|---|---|
| 3,414,769 | 12/1968 | Hoffman | 361/235 |
| 4,194,232 | 3/1980 | Cumming et al. | 361/213 |
| 4,333,123 | 6/1982 | Moulden | 361/213 |
| 4,336,565 | 6/1982 | Murray et al. | 361/221 X |
| 4,486,808 | 12/1984 | Cardone | 361/235 |

*Primary Examiner*—L. T. Hix
*Assistant Examiner*—D. Rutledge
*Attorney, Agent, or Firm*—William W. Haefliger

[57] ABSTRACT

Film is cleaned by:

(a) providing a cleaning zone and passing film laterally through that zone, (b) providing streams of gas flowing toward opposite sides of the film as it passes in that zone, (c) supplying ions of opposite polarity to the air streams and in cyclically reversing polarity relation, (d) and also brushing the film opposite sides as the film passes through that zone, thereby causing the brushes to center the film as it passes through the zone.

20 Claims, 5 Drawing Sheets

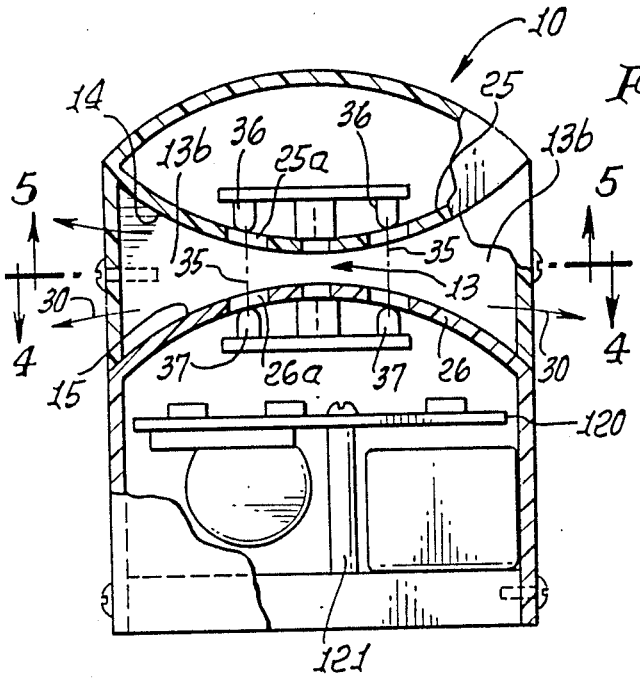
FIG. 2a.
FIG. 3.
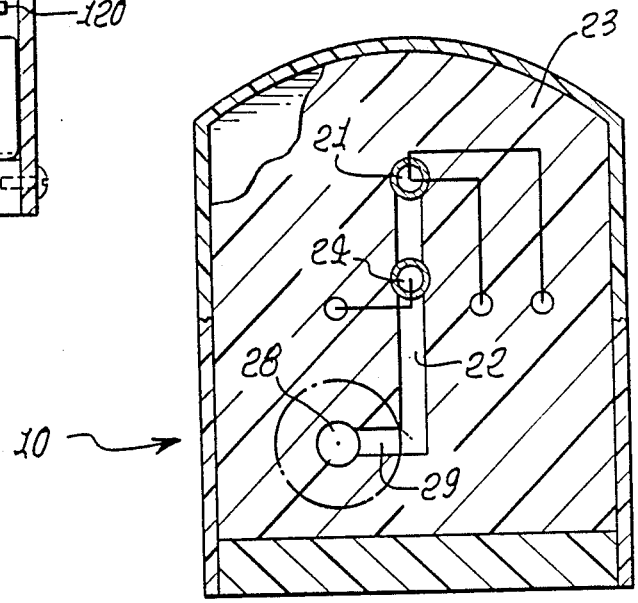
FIG. 4.
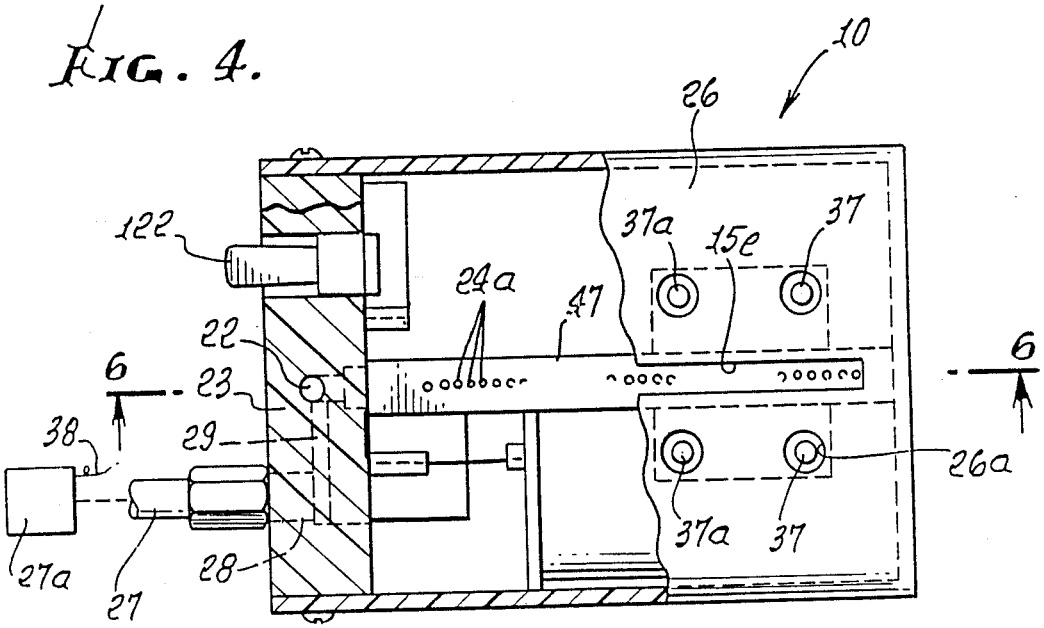

FIG. 5.
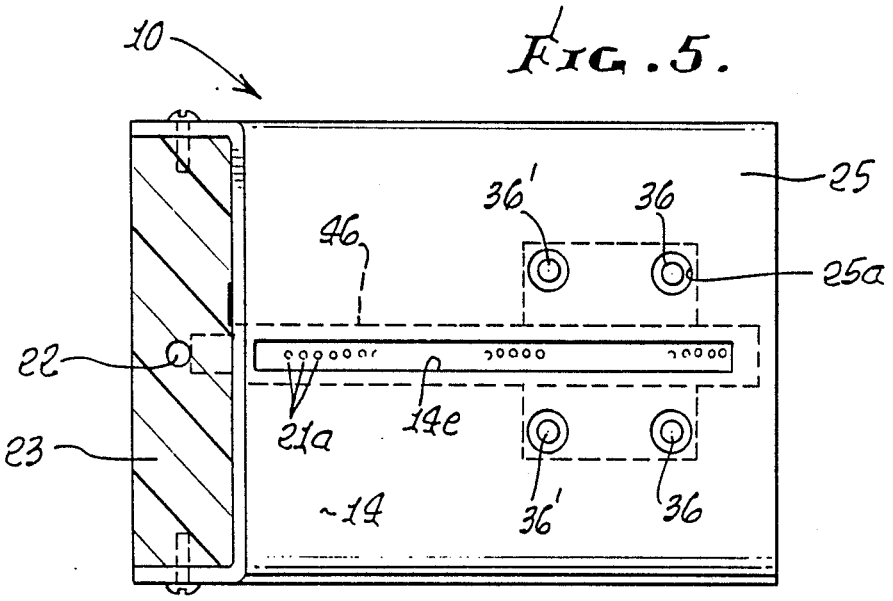
FIG. 6.
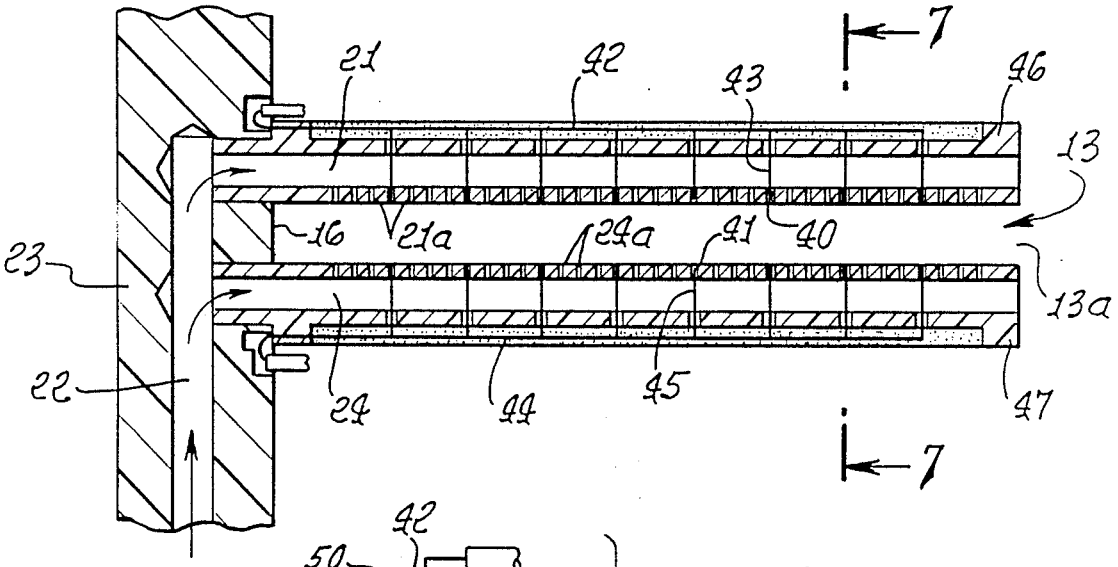
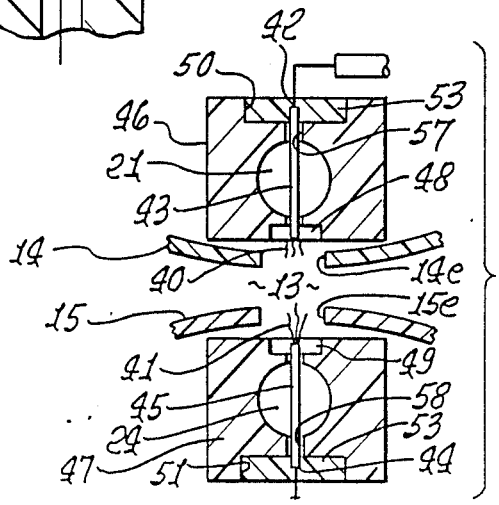
FIG. 7.

TIME
VOLTAGE
UPPER BAR TIPS
LOWER BAR TIPS
70
80
81
82
83
84
85
88
89
90
91
92
93
104
105
106
107
108
109
110
111
112
113
122
36
37
40
41
42
44
72
72a
72b
72c
73
73a
73b
73c

FILM CLEANER METHOD AND APPARATUS

This application is a continuation-in-part of Ser. No. 014,729, filed Feb. 13, 1987, now U.S. Pat. No. 4,750,080.

BACKGROUND OF THE INVENTION

This invention relates generally to treatment of photographic film, and more particularly concerns removal of dust from film surfaces as well as elimination of static on such surfaces, so as to remove dust from film.

In the past, devices have been constructed which employ nuclear pellets to ionize air which is blasted over film. The cost of such equipment is objectionable, in view of the need for frequent replacement of the nuclear pellets, which are individually expensive.

SUMMARY OF THE INVENTION

It is a major object of the present invention to provide apparatus and method to overcome the above problems and heavy expense. Basically, the apparatus comprises:

(a) first means forming a cleaning zone to receive film passed through said zone, (b) second means for passing streams of gas flowing toward opposite sides of the film as it passes in said zone, (c) third means for supplying ions of opposite polarity to said gas streams and in cyclically reversing polarity relation, (d) and fourth means including brushes for brushing the film opposite sides as the film passes through said zone, thereby causing the brushes to center the film as it passes through said zone.

As will be seen, there are advantageously two sets of said brushes projecting oppositely toward one another and into brush tip adjacency and engagement, to provide a barrier to said air streams at opposite sides of the barrier whereby the air streams at each side of the barrier flow away from the barrier, carrying brush removed particles out of said zone; and the third means includes circuitry for cyclically reversing the polarity of ions supplied to each of two gas streams at each side of the brush barrier, one gas stream flowing toward one side of the film at each side of the brush barrier, and another gas stream flowing toward the opposite side of the film at the opposite side of the brush barrier; the polarity of ions supplied to said one stream is positive when the polarity of ions supplied to the other stream is negative, and vice versa; fine wire clusters are provided to have ion dispensing tips at upper and lower sides of the cleaning zone; and a succession of half cycle voltages are applied to the tips exposed to each of said streams, and characterized in that the half cycles are alternately positive and negative to said tips.

Further, the third means may advantageously include cables connected to opposite end taps of a transformer secondary coil which is center tapped to ground, and cable branches have ion dispensing terminal fine wire clusters exposed to the cleaning zone at upper and lower sides thereof.

As a result, much lower voltage is needed to effect the same degree of cleaning of film as in prior apparatus (i.e. about ±1,400 VAC, as compared with prior then required voltage ±4,000 VAC); and the apparatus is simpler, more rugged and more reliable, ensuring dust-free, static free film negatives for printing and/or duplicating.

Finally, a rotary fan may be incorporated in a housing for the above described elements, the fan operating to create the described air streams.

These and other objects and advantages of the invention, as well as the details of an illustrative embodiment, will be more fully understood from the following specification and drawings, in which:

DRAWING DESCRIPTION

Figure 2:
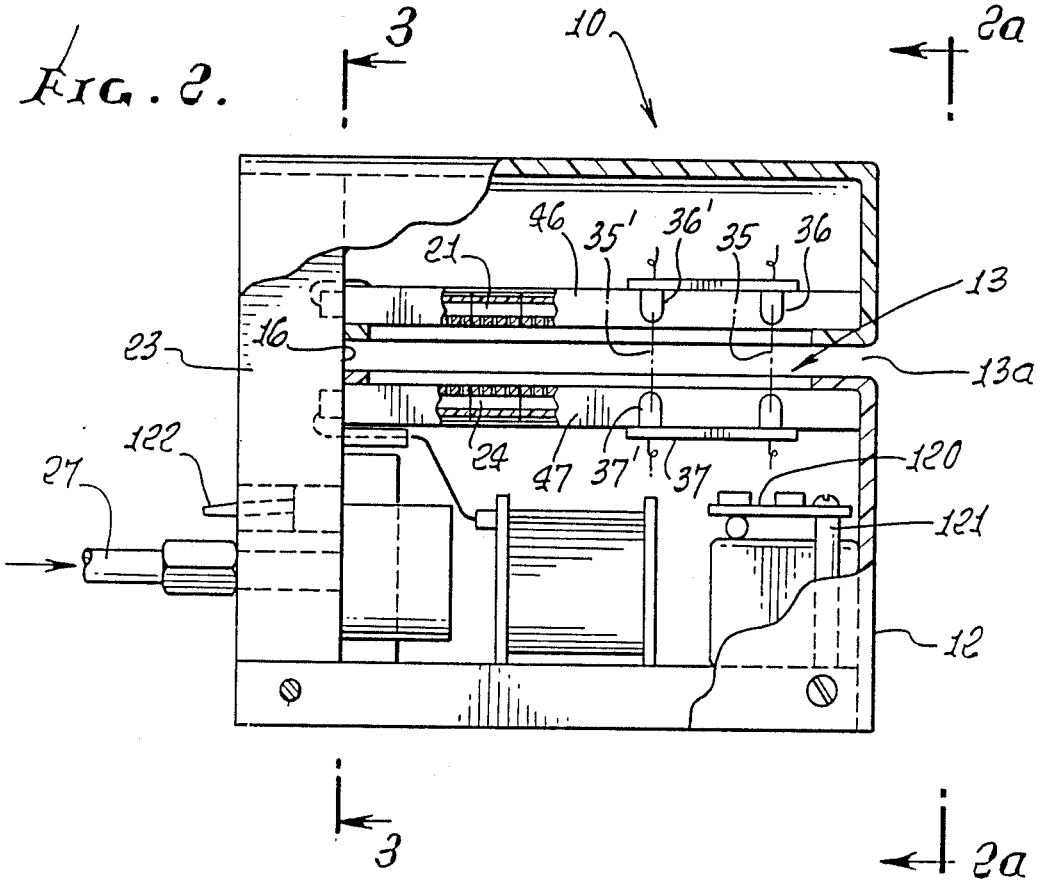
FIG. 2 is a side elevation, taken in section through the FIG. 1 apparatus.

FIG. 2*a* is an end elevation taken on lines 2*a*—2*a* of FIG. 2;

FIG. 3 is a vertical section taken on lines 3—3 of FIG. 2;

FIG. 4 is a plan view, looking downwardly, taken on lines 4—4 of FIG. 2*a;*

FIG. 5 is a section on lines 5—5 of FIG. 2*a;*

Figures 8, 9:
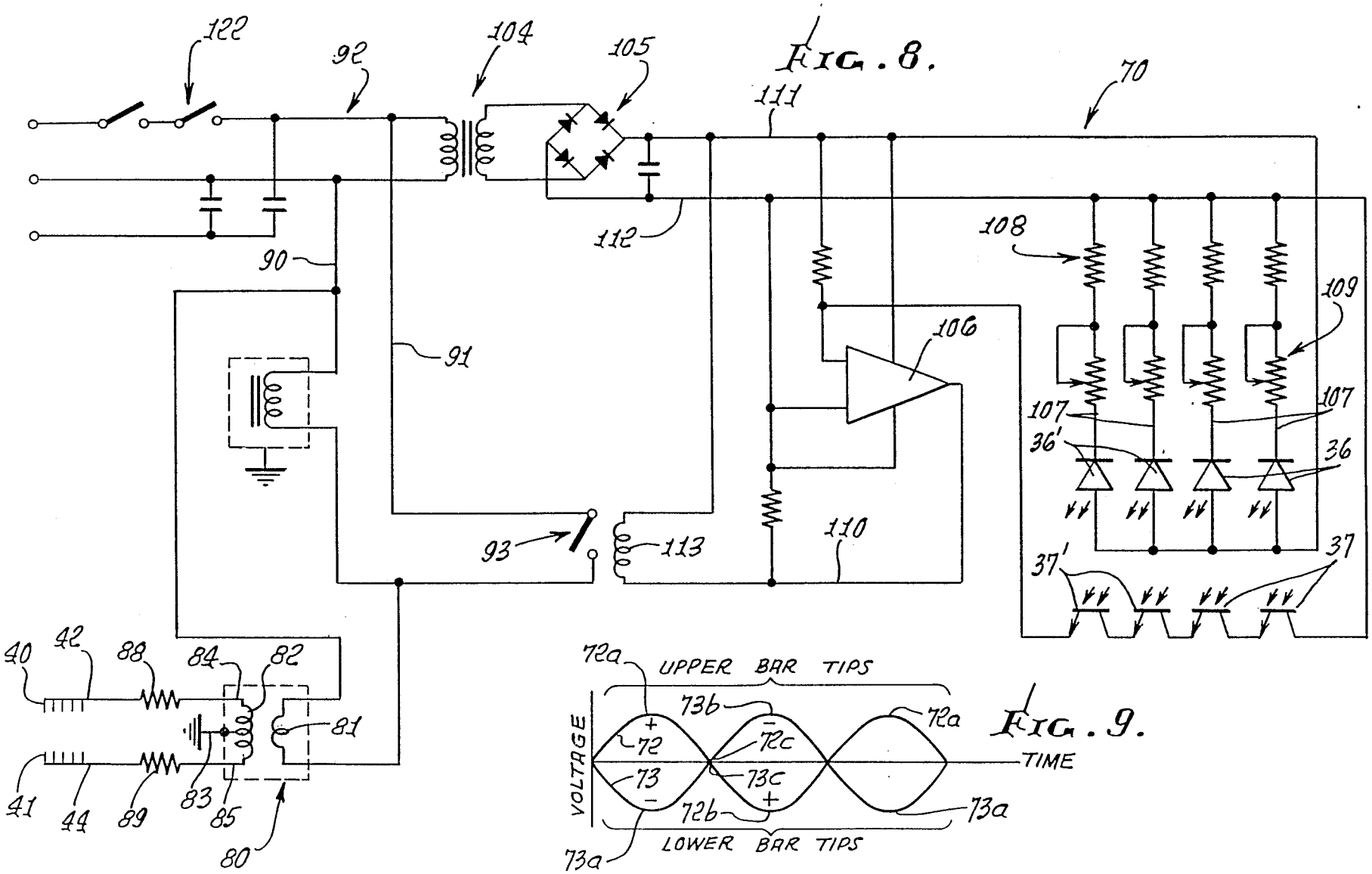
Figure 10:
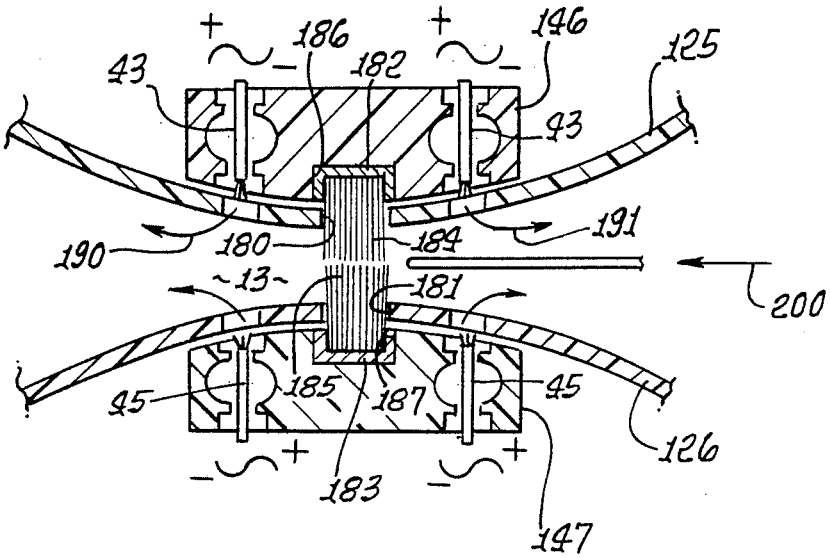
Figure 11:
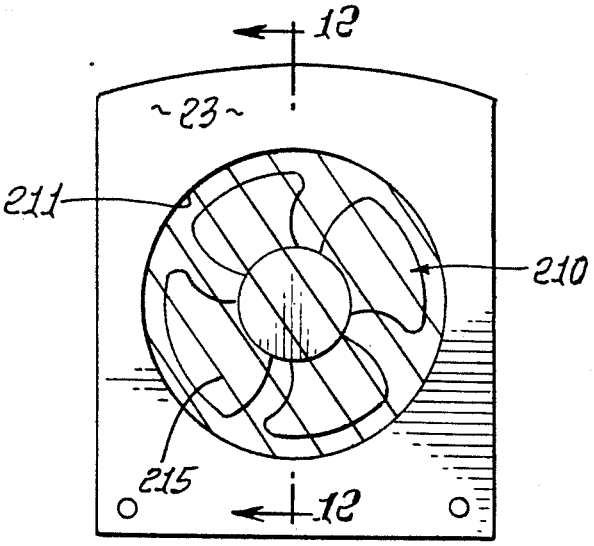

FIG. 6 is an enlarged fragmentary view taken in elevation on lines 6—6 of FIG. 4;

FIG. 7 is a section on lines 7—7 of FIG. 6;

FIG. 8 is a circuit diagram;

FIG. 9 is a voltage polarity timing diagram, as applied to upper and lower ion dispensing tips;

FIG. 10 is a view like FIG. 2*a*, but showing a modification;

FIG. 11 is an end view of a modified apparatus; and

Figure 12:
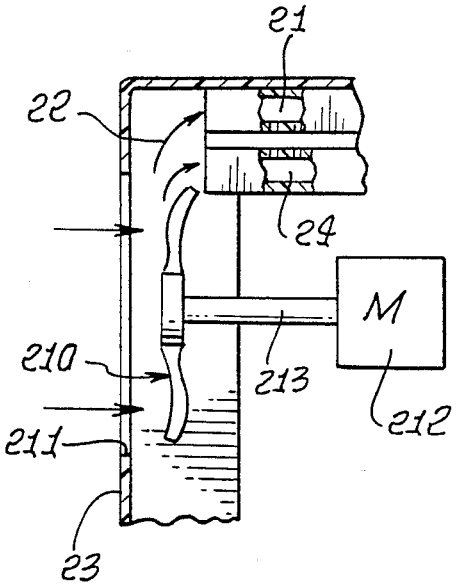

FIG. 12 is a section on lines 12—12 of FIG. 11.

DETAILED DESCRIPTION

Figure 1:
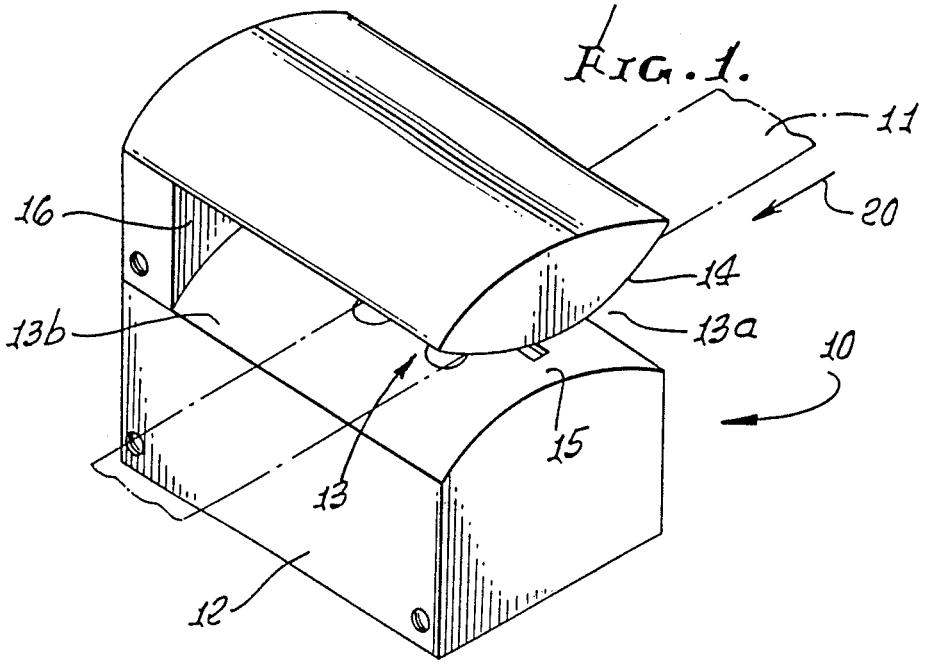
FIG. 1 is a perspective view showing apparatus in accordance with the invention.

In FIGS. 1–7, the apparatus 10 for treating photographic film 11 (which may include microfiche) includes a support 12 and means associated with the support defining a film treatment zone 13 in the shape of a recess having a front opening 13*a* and opposite side openings 13*b*. The latter are spaced apart laterally to pass the film through the zone 13 which typically has venturi shape as seen in FIG. 1. Such means may comprise upper and lower curved surfaces 14 and 15. Surface 14 is downwardly convex in end elevation as seen in FIG. 2*a*. Surface 15 is upwardly convex in elevation as seen in FIG. 2*a*. A support or body wall 16 closes the rear side of recess 13.

Means is also provided to supply streams of pressurized gas such as air or nitrogen to zone 13, and closely adjacent opposite faces of film 11 passing laterally through the treatment zone. See in this regard the travel direction indicated by arrows 20 in FIG. 1. Such means may include the upper duct 21 in the support body above zone 13, the lower duct 24 in the body below zone 13, and supply duct 22 in wall 23. A compressed air supply is indicated at 27, with lines 28 and 29 leading to ducts 22, 23 and 24 as indicated. Outlets from the branch ducts 21 and 24 appear at 21*a* and 24*a* facing a throat portion of zone 13. Accordingly, dust is swept off the upper and lower sides of the film as it passes through the zone 13. The gaseous streams tend to flow laterally beyond the recess ends 13*b* in FIG. 1, as indicated by arrows 30.

FIG. 2*a* shows two photoelectric beams 35 passing from generators 37 to detectors 36, at opposite sides of the throat region. Beams 35 pass through openings 25*a* in curved wall 2, and openings 26*a* in a curved wall 26. An additional and redundant pair of beams 35' is provided between generators 36' and detectors 37'. Upon interruption of either beam, as by entry of the film into recess or zone 13, an air supply motor 27a is activated, to drive the air supply pump (for example) whereby air is automatically supplied to zone 13 only when the film is in zone 13. An electrical connection from detectors 37 to the motor 27a is indicated at 38.

Also provided is apparatus to supply ions of opposite polarity to the gas streams flowing toward opposite sides of the film and in cyclically reversing polarity relation. Such means includes ion dispensing tips 40 and 41 exposed to the zone 13 and the air or gas streams in such zones. Downward facing tips 40 are supplied with high voltage as by main cable 42 and cable branches 43 extending downwardly through duct 21, and upward facing and projecting tips 41 are supplied with high voltage as by main cable 44 and cable branches 45 extending upwardly through duct 22. See FIG. 7 showing synthetic resinous and insulative, elongated bars 46 and 47 of rectangular outline that form ducts 21 and 22 and carry the cables, branches and tips located at the branch terminals. Multiple tips in the form of clusters of fine wires (platinum, for example) are formed to yield best results in terms of flooding the zone 13 with ions, and redundancy of tips to assure workability enhanced ion production.

Tips 40 extend in recesses 48 in bar 46, and tips 40 extend in recesses 49 in bar 47, those recesses formed between groups of the outlets 21a and 24a, as is clear from FIG. 6. Other recesses 50 and 51 in the bars receive the main cables 42 and 44, about which insulations resinous material 53 is filled in or potted, as seen in FIG. 7. If desired, small ports 57 and 58 may be formed in bars 46 and 47 to pass air about branches 43 and 45 to recesses 48 and 49, to sweep ions off the fine wire tips, and toward the opposite sides of the film.

Further, the ion supply means typically includes circuitry 70 (see FIG. 8, for example) for cyclically reversing the polarity of ions supplied to each of two of the gas streams, one stream or streams flowing toward one side of the film, and the other stream or streams flowing toward the opposite side of the film. Reference to FIG. 9 shows that high positive voltage 72 is supplied to the tips at the upper bar to peak at 72a, and then to the tips at the lower bar to peak at 72b, etc. in cyclic relation; and that high negative voltage 73 is supplied to the tips at the upper bar to peak at 73b, and then again to the tips at the lower bar to peak again at 73a, etc. Positive peaks 72a are opposite peaks 73a (i.e. occur simultaneously); and peaks 73b are opposite peaks 72b. Also, see cyclic nodes 72c and 73c occurring simultaneously, between the peaks. It is therefore seen that each side of the film, at the throat of the venturi where gas velocity streams are greatest, is successively and rapidly (60 Hertz for example) subject to oscillation of high voltage between positive and negative peaks, so that dust particles are subjected to optimizee electrostatic field differentials. A succession of half cycle high voltages alternately positive and negative DC, i.e. alternating DC pulses, are applied to the tips. This is important when it is considered that the film passes randomly closer to or further from one or the other of the two surfaces 14 and 15, near throat openings in the surfaces to pass the ions and air streams applied at 14e and 15e.

Circuitry to develop the high voltage wave forms 72 and 73 is shown in FIG. 8. It includes a transformer 80 having primary and secondary coils 81 and 82. The secondary 82 is center-tapped to ground, at 83. The end terminals 84 and 85 of the coil 82 are respectively connected at 42 and 44, and via resistors 88 and 89 to the emitters or tips, indicated at 40 and 41, and as described previously. The end terminals of the primary coil are connected, as indicated at 90 and 91, across the 60 cycle 120 volt line 92, switch 93 (relay for example) connected in line 91.

Supply circuitry for the phototransistors, described previously at 36 and 37, is indicated as including transformer 104, rectifier bridge 105, operational amplifier 106, and four lines 107 leading via resistors 108 and 109 to the beam generators 36 and 36' and the detectors (phototransistors) 37 and 37'. When any of the beams is interrupted by film passage, amplifier 106 causes flow of current in line 110, i.e. across lines 11 and 112, energizing the relay coil 113 and closing switch 93. This in turn effects ion transmission by emitters 40 and 41, as described.

A circuit board 120 is mounted at 121; and an ON/-OFF switch appears at 122.

Referring now to FIGS. 10–12, the construction and functioning are the same as in FIGS. 1–9, excepting for the following:

The curved walls 125 and 126 form upper and lower slots 180 and 181 for reception of u-shaped brush holders 182 and 183. The latter retain the brushes 184 and 185 to project into the throat portion of zone 13, and toward one another so that the oppositely projecting brush tips overlap and engage one another. The brush holders snap-into the recesses 186 and 187 formed by the elongated bars 146 and 147 that correspond to bars 46 and 47, above. As film such as negatives is passed through zone 13 in the direction of arrow 200, the upper and lower surfaces are thoroughly but lightly brushed to push off any barrier particles thereon. The brushes may consist of Nylon bristles, or equivalent.

The bars 146 and 147 form two sets of structures like those shown in FIG. 7, and bearing the same numbers, except for the structures offset from the throat region of zone 13, as shown. Thus, one structure is at one side of the brushes, whereas the other structure is at the other side of the brushes. See elements 43 and 45.

Accordingly, the brushes form a barrier to the air streams at opposite sides of the barrier, whereby the air streams at each side of the barrier flow away from the barrier, carrying brush removed particles out of said zone. Also, the means to supply ions of opposite polarity to the air or gas streams includes means for cyclically reversing the polarity of ions supplied to each of two air streams at each side of the barrier, one air stream flowing toward one side of the film at each side of the barrier, and another air stream flowing toward the opposite side of the film at each side of the barrier. See in this regard FIG. 10 showing cyclic voltage waveforms associated with (i.e. applied to) the cable branches 43 and 45. This combination of brush barriers, air flow in opposite directions 190 and 191 away from the barrier, and ion polarity reversal, achieves exceptionally good cleaning of all forms of dust and particulate from the film opposite surfaces, such cleaning being both positive and electrostatically induced. Circuitry as shown in FIG. 8 is employed for each of the two sets of branches 43 and 45, to produce cycling voltages as seen in FIG. 9, at each set. Also, the brushes center the film in zone 13.

FIGS. 11 and 12 show a rotary fan 210 within the housing, i.e. just inside wall 23. An opening 211 in that wall passes air into the center of the fan, and such air is expelled peripherally to flow in duct 22 to channels 21 and 24 associated with each set of branches 43 and 45, as described above. The fan is rotated as by a motor 212 within the case, and having a shaft 213 on which the fan is mounted.

The brushes may be periodically cleaned by passing a plastic cleaning rod endwise along the lengths of the brushes. They extend lengthwise, throughout the lengths of zone 13 normal to FIG. 10.

See also protective grid 215 covering opening 211.

We claim:

1. The method of cleaning film, employing two sets of brushes, that includes:

(a) providing a cleaning zone and passing film laterally through that zone, (b) providing streams of gas flowing toward opposite sides of the film as it passes in said zone, (c) supplying ions of opposite polarity to said air streams and in cyclically reversing polarity relation, (d) and also brushing the film opposite sides as the film passes through said zone, thereby causing the brushes to center the film as it passes through said zone.

2. The method of claim 1 wherein said c) step includes cyclically reversing the polarity of ions supplied to each of two air streams, one air stream flowing toward one side of the film and another air stream flowing toward the opposite side of the film.

3. The method of claim 2 wherein the polarity of ions supplied to said one air stream is positive when the polarity of ions supplied to the other air stream is negative, and vice versa.

4. The method of claim 2 wherein ion dispensing tips are exposed to said air streams, and wherein cyclically varying high voltages are applied to said tips.

5. The method of claim 4 wherein a succession of half cycle voltages are applied to the tips exposed to each of said streams, and characterized in that the half cycles are alternately positive and negative DC voltages.

6. The method of claim 1 including operating a rotary fan to create said air streams flowing from the periphery of the fan to opposite sides of the film.

7. The method of claim 1 including directing the air streams onto the film sides before and after the film is brushed.

8. The method of claim 7 including locating the brushes to provide a barrier to said air streams at opposite sides of the barrier whereby the air streams at each side of the barrier flow away from the barrier, carrying brush removed particles out of said zone.

9. The method of claim 8 wherein said c) step includes cyclically reversing the polarity of ions supplied to each of two air streams at each side of the barrier, one air stream flowing toward one side of the film at each side of the barrier, and another air stream flowing toward the opposite side of the film at each side of the barrier.

10. In apparatus for cleaning film, the combination comprising (a) first means forming a cleaning zone to receive film passed through said zone, (b) second means for passing streams of gas flowing toward opposite sides of the film as it passes in said zone, (c) third means for supplying ions of opposite polarity to said gas streams and in cyclically reversing polarity relation, (d) and fourth means including brushes for brushing the film opposite sides as the film passes through said zone, thereby causing the brushes to center the film as it passes through said zone.

11. The apparatus of claim 10 wherein said third means includes circuitry for cyclically reversing the polarity of ions supplied to each of two gas streams, one gas stream flowing toward one side of the film and another gas stream flowing toward the opposite side of the film.

12. The apparatus of claim 11 wherein the polarity of ions supplied to said one stream is positive when the polarity of ions supplied to the other stream is negative, and vice versa.

13. The apparatus of claim 11 wherein said c) means includes ion dispensing tips exposed to said air streams, and wherein cyclically varying high voltages are applied to said tips.

14. The apparatus of claim 13 wherein a succession of half cycle voltages are applied to the tips exposed to each of said streams, and characterized in that the half cycles are alternately positive and negative DC voltages.

15. The apparatus of claim 10 wherein said third means includes a transformer secondary coil having a grounded center tap, the end terminals of said coil respectively connected to the tips exposed to the air streams flowing to opposite sides of the film.

16. The apparatus of claim 10 including a housing for said (a), (b) and (c) means, and said (b) means includes a rotary fan operating to create said air streams flowing from the periphery of the fan to opposite sides of the film.

17. The apparatus of claim 16 wherein the housing includes parts at opposite sides of said brushes to direct two air streams onto the film before and after the film is brushed.

18. The apparatus of claim 10 wherein there are two sets of said brushes projecting oppositely toward one another and into brush tip adjacency and engagement, to provide a barrier to said air streams at opposite sides of the barrier whereby the air streams at each side of the barrier flow away from the barrier, carrying brush removed particles out of said zone.

19. The apparatus of claim 18 wherein said (c) means includes means for cyclically reversing the polarity of ions supplied to each of two air streams at each side of the barrier, one air stream flowing toward one side of the film at each side of the barrier, and another air stream flowing toward the opposite side of the film at each side of the barrier.

20. The apparatus of claim 10 wherein said third means includes cables connected to opposite end taps of a transformer secondary coil which is center tapped to ground, and cable branches having ion dispensing terminal fine wire clusters exposed to said cleaning zone at upper and lower sides thereof.

* * * * *